US007987825B2

(12) United States Patent
Hwang

(10) Patent No.: US 7,987,825 B2
(45) Date of Patent: Aug. 2, 2011

(54) VARIABLE VALVE LIFT APPARATUS

(75) Inventor: Yun Sung Hwang, Suwon (KR)

(73) Assignee: Hyundai Motor Company, Seoul (KR)

( * ) Notice: Subject to any disclaimer, the term of this patent is extended or adjusted under 35 U.S.C. 154(b) by 536 days.

(21) Appl. No.: 12/143,069

(22) Filed: Jun. 20, 2008

(65) Prior Publication Data

US 2009/0151681 A1 Jun. 18, 2009

(30) Foreign Application Priority Data

Dec. 12, 2007 (KR) ..... 10-2007-0129401

(51) Int. Cl.
*F01L 1/34* (2006.01)

(52) U.S. Cl. ..... 123/90.16; 123/90.33; 123/90.35; 123/90.48

(58) Field of Classification Search ..... 123/90.5, 123/90.16, 90.48, 90.55, 90.56, 90.57, 90.32, 123/90.35, 90.58, 90, 59, 90.33, 90.34
See application file for complete search history.

(56) References Cited

U.S. PATENT DOCUMENTS

| | | | | |
|---|---|---|---|---|
| 6,125,804 | A * | 10/2000 | Kawai et al. | 123/90.16 |
| 6,397,806 | B2 * | 6/2002 | Imai et al. | 123/90.48 |
| 6,470,840 | B1 * | 10/2002 | Ebesu et al. | 123/90.17 |
| 7,210,437 | B2 * | 5/2007 | Geyer | 123/90.5 |
| 2007/0289565 | A1 * | 12/2007 | Fujii et al. | 123/90.33 |

* cited by examiner

*Primary Examiner* — Thomas E Denion
*Assistant Examiner* — Daniel A Bernstein
(74) *Attorney, Agent, or Firm* — Morgan, Lewis & Bockius LLP

(57) ABSTRACT

A variable valve lift apparatus according to an exemplary embodiment of the present invention includes an outer body connected with a valve for opening and closing the valve, an inner body that is reciprocally disposed within the outer body and contacts a first input cam configured to an input shaft, a lost motion spring disposed between the outer body and the inner body, a connecting portion selectively connecting the outer body and the inner body, a hydraulic pressure supplying portion supplying hydraulic pressure to the connecting portion, and a lubrication circuit supplying lubricant to a contacting portion of the first input cam and the inner body.

10 Claims, 4 Drawing Sheets

VARIABLE VALVE LIFT APPARATUS

CROSS-REFERENCE TO RELATED APPLICATION

This application claims priority to and the benefit of Korean Patent Application No. 10-2007-0129401 filed in the Korean Intellectual Property Office on Dec. 12, 2007, the entire contents of which are incorporated herein by reference.

BACKGROUND OF THE INVENTION (a) Field of the Invention

The present invention relates to a variable valve lift apparatus. More particularly, the present invention relates to a variable valve lift apparatus that is provided with a hydraulic line therein, so that durability and performance may be improved.

(b) Description of the Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a variable valve lift apparatus that may realize various lift operation ranges.

A variable valve lift apparatus according to an exemplary embodiment of the present invention is provided with a hydraulic line therein, so that durability and performance may be improved.

A variable valve lift apparatus according to an exemplary embodiment of the present invention may include an outer body connected with a valve for opening and closing the valve, an inner body that is reciprocally disposed within the outer body and contacts a first input cam configured to an input shaft, a lost motion spring disposed between the outer body and the inner body, a connecting portion selectively connecting the outer body and the inner body, a hydraulic pressure supplying portion supplying hydraulic pressure to the connecting portion, and a lubrication circuit supplying lubricant to a contacting portion of the first input cam and the inner body.

The connecting portion may comprise a guide channel formed in a portion of the outer body, at least a connecting pin disposed in the guide channel, the connecting pin inserted into the inner body according to hydraulic pressure receiving from the hydraulic pressure supplying portion, and a return spring disposed in the guide channel, the return spring supplying restoring force to the connecting pin.

The hydraulic pressure supplying portion may comprise an oil supplying hole formed to the outer body and fluidly communicating with the guide channel of the connecting portion, and the lubrication circuit comprises a first hydraulic line formed in one of the at least a connecting pin and a second hydraulic line formed in a guide of the inner body.

The second hydraulic line may fluidly communicate with a contact surface of the inner body and a portion of the guide of the inner body.

A lost motion chamber may be formed in the outer body for a portion of the guide of the inner body to be inserted therein when the connecting pin is separated from the inner body.

A key hole may be formed to an external circumference of the outer body along a direction of reciprocating motion of the outer body, and a key is disposed to the key hole.

The variable valve apparatus may further comprise a second input cam that is disposed to the input shaft and selectively contacts the outer body.

The first input cam may be a high lift cam and the second input cam may be a low lift cam.

The connecting portion may comprise: a guide channel formed in a portion of the outer body, at least a connecting pin disposed in the guide channel, the connecting pin inserted into the inner body according to hydraulic pressure receiving from the hydraulic pressure supplying portion, and a return spring disposed in the guide channel, the return spring supplying restoring force to the connecting pin.

The hydraulic pressure supplying portion may comprise an oil supplying hole formed to the outer body and fluidly communicating with the guide channel of the connecting portion, and the lubrication circuit comprises a first hydraulic line formed in one of the at least a the connecting pin and a second hydraulic line formed in a guide of the inner body.

The second hydraulic line may fluidly communicate with a contact surface of the inner body and a portion of the guide of the inner body.

A lost motion chamber may be formed in the outer body for the inner body to be inserted therein when the connecting pin is separated from the inner body.

A key hole may be formed to an external circumference of the outer body along a direction of reciprocating motion of the outer body, and a key is disposed to the key hole.

As stated above, the variable valve lift apparatus according to an exemplary embodiment of the present invention is provided with a hydraulic line therein, so that durability and performance may be improved.

Figure 1:
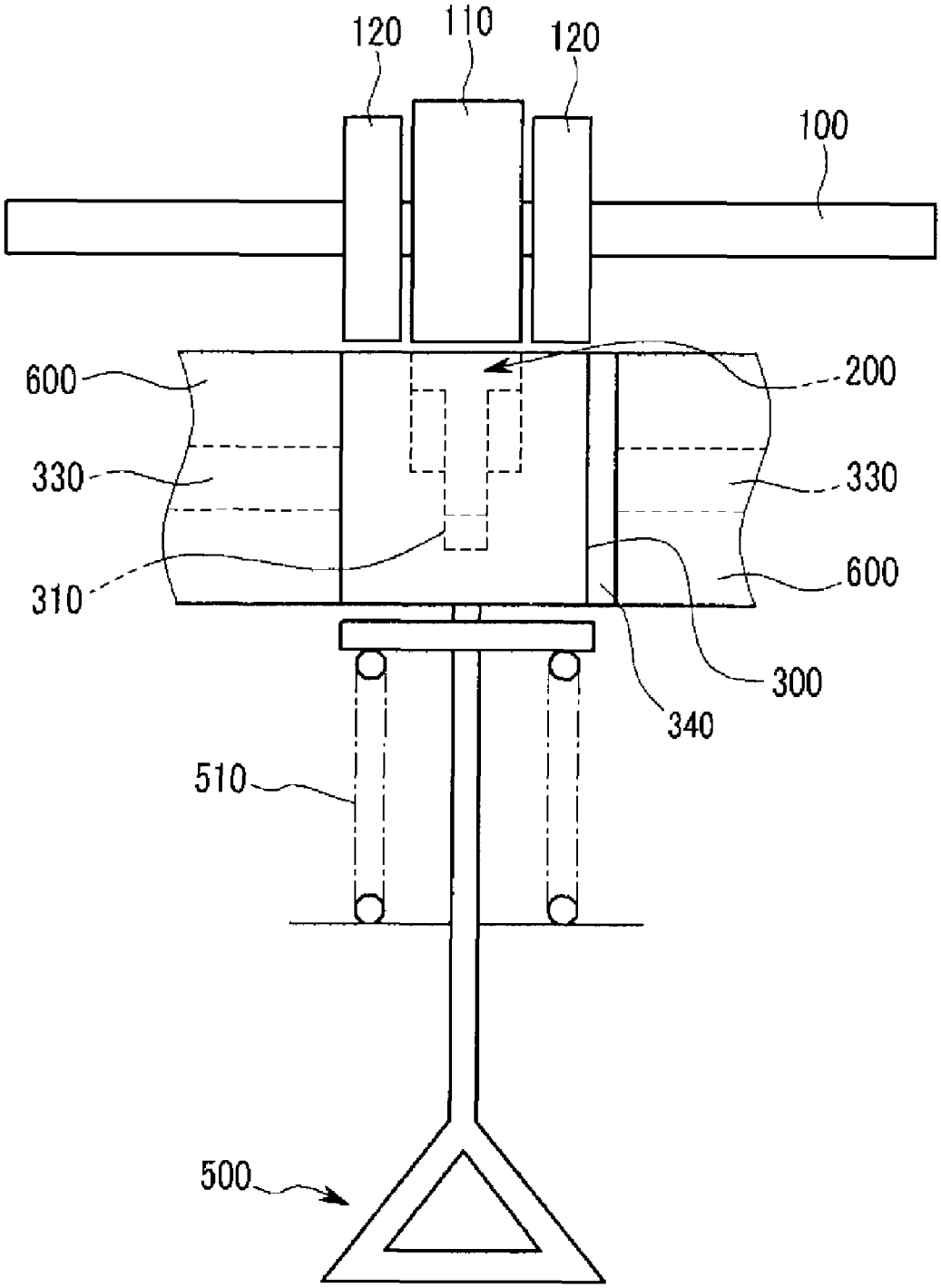
FIG. 1 is a front view of a variable valve lift apparatus according to an exemplary embodiment of the present invention.

In the figures, reference numbers refer to the same or equivalent parts of the present invention throughout the several figures of the drawing.

REPRESENTATIVE REFERENCE NUMERALS

100: input shaft
110: first input cam

120: second input cam
200: inner body
300: outer body
310: lost motion chamber
320: oil supplying hole
330: hydraulic pressure supplying portion
340: key
350: key hole
400: connecting portion
410: connecting pin
420: return spring
430: first hydraulic line
440: second hydraulic line
500: valve
510: valve spring
600: cylinder head
700: lost motion spring

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Referring to FIG. 1 to FIG. 4, construction of a variable valve lift apparatus according to an exemplary embodiment of the present invention will be explained.

A variable valve lift apparatus according to an exemplary embodiment of the present invention includes a first input cam 110 and a second input cam 120 that are disposed to an input shaft 100.

An outer body 300 connected to a valve 500 for opening and closing the valve 500 selectively contacts the second input cam 120, and an inner body 200 that is capable of reciprocal motion within the outer body 300 is disposed in the outer body 300 and contacts the first input cam 110. The valve 500 receives elastic force from a valve spring 510.

A lost motion spring 700 is disposed between the outer body 300 and the inner body 200.

A connecting portion 400 extending from an inner circumference of the outer body 300 is disposed for selectively connecting the outer body 300 and the inner body 200. A hydraulic pressure supplying portion 330 is formed outside the outer body 300 for supplying hydraulic pressure to the connecting portion 400, and a lubrication circuit 450 is formed at the inner body 200 and the connecting portion 400 for supplying lubricant to a portion where the inner body 200 contacts the first input cam 110.

The connecting portion 400 includes a connecting pin 410, wherein a distal end portion of the connecting pin 410 is selectively inserted into the inner body 200 according to hydraulic pressure receiving from the hydraulic pressure supplying portion 330 through the oil supplying hole 320, and a return spring 420 disposed around a distal portion of the connecting pin 410, wherein the return spring 420 supplies restoring force to the connecting pin 410, and a guide channel 425 receiving the connecting pin 410 and the return spring 420 therein.

The hydraulic pressure supplying portion 330 includes an oil supplying hole 320 formed to a lower external surface of the outer body 300, and the lubrication circuit 450 includes a first hydraulic line 430 formed inside the connecting pin 410 in the longitudinal direction thereof and a second hydraulic line 440 formed inside a guide 210 of the inner body 200 wherein the guide 210 is disposed substantially vertical to the guide channel 425 of the connecting portion 400. The guide 210 extends downwards from top portion of the inner body 200.

The hydraulic pressure supplying portion 330 is formed in a cylinder head 600 for supplying hydraulic pressure.

A lost motion chamber 310 is formed in lower portion of the outer body 300 for the inner body 200 to be inserted therein when the connecting pin 410 is separated from the inner body 200. In detail, the guide 210 of the inner body 200 is slidably received into the lost motion chamber 310 according to change of mode.

The first input cam 110 may be a high lift cam and the second input cam 120 may be a low lift cam.

Figure 2:
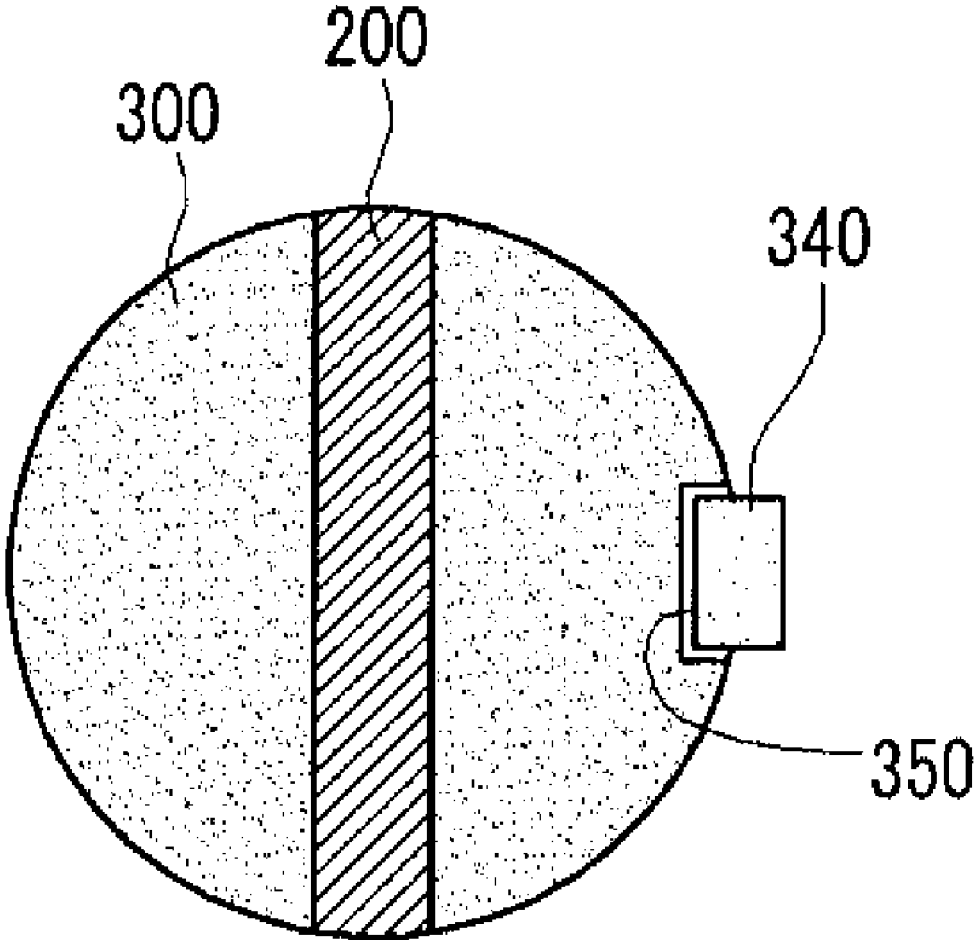
FIG. 2 is a partial top plan view of a variable valve lift apparatus according to an exemplary embodiment of the present invention.
Figure 3:
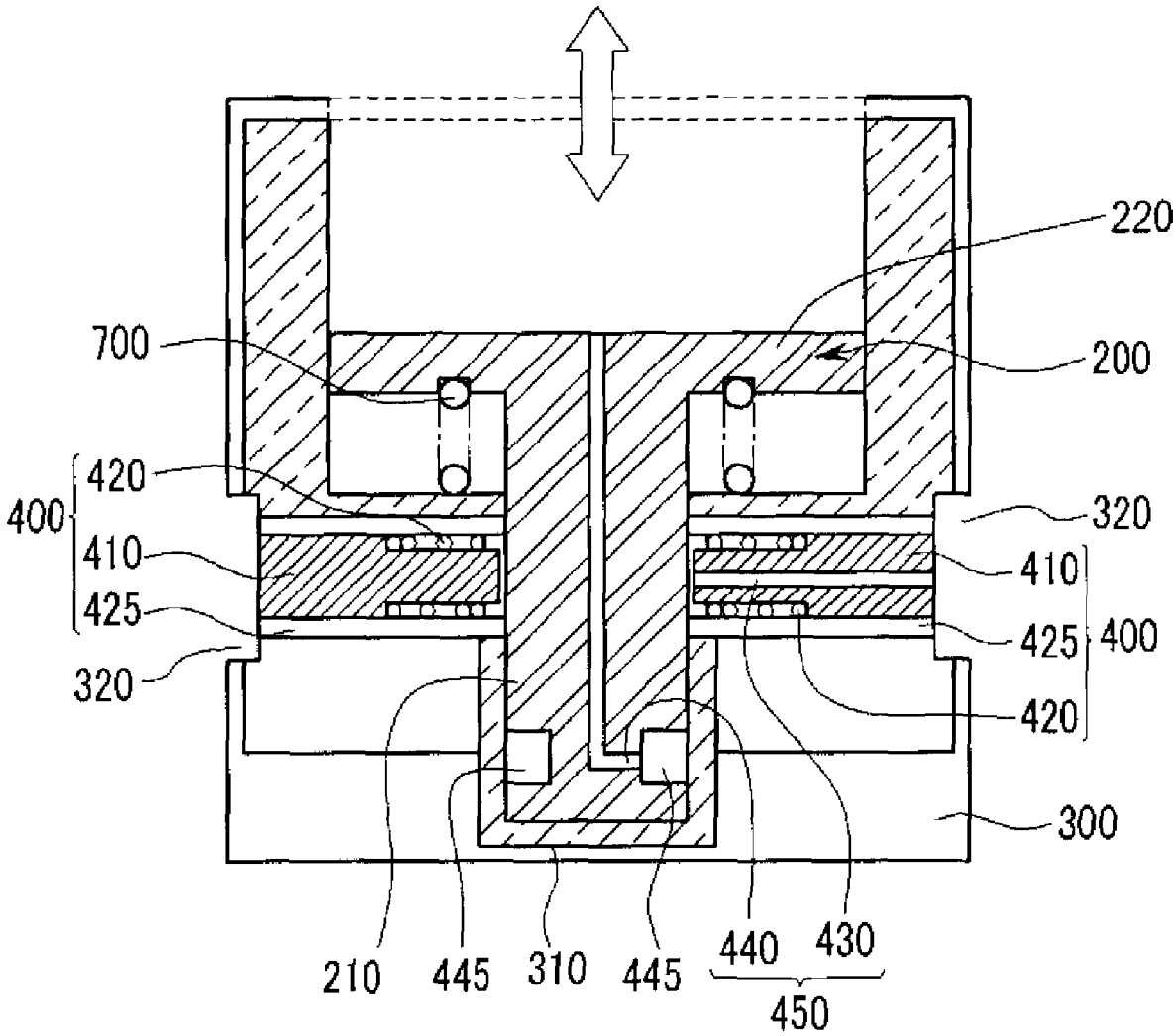
FIG. 3 is a cross-sectional view of a variable valve lift apparatus according to an exemplary embodiment of the present invention in a low lift mode.

Referring to FIG. 1 and FIG. 2, a key hole 350 is formed to an external circumference of the outer body 300 along a direction of reciprocating motion of the outer body 300, and a key 340 is disposed to the key hole 350 so that rotation of the outer body 300 may be prevented when the outer body 300 reciprocates.

Hereinafter, an operation of the variable valve lift apparatus according to an exemplary embodiment of the present invention will be explained.

Hydraulic pressure is not supplied to the connecting pin 410 in a low lift mode. Accordingly, the connecting pin 410 is disconnected from the inner body 200 by restoring force of the return spring 420 and thus the inner body 200 has lost motion along the lost motion chamber 310. That is, the inner body 200 reciprocates in the outer body 300 in the arrow direction shown in FIG. 3, and the outer body 300 reciprocates upwards and downwards by lost motion spring 700 positioned between the inner body 200 and the outer body 300 and opens/closes the valve 500 in response to rotation of the second input cam 120.

Figure 4:
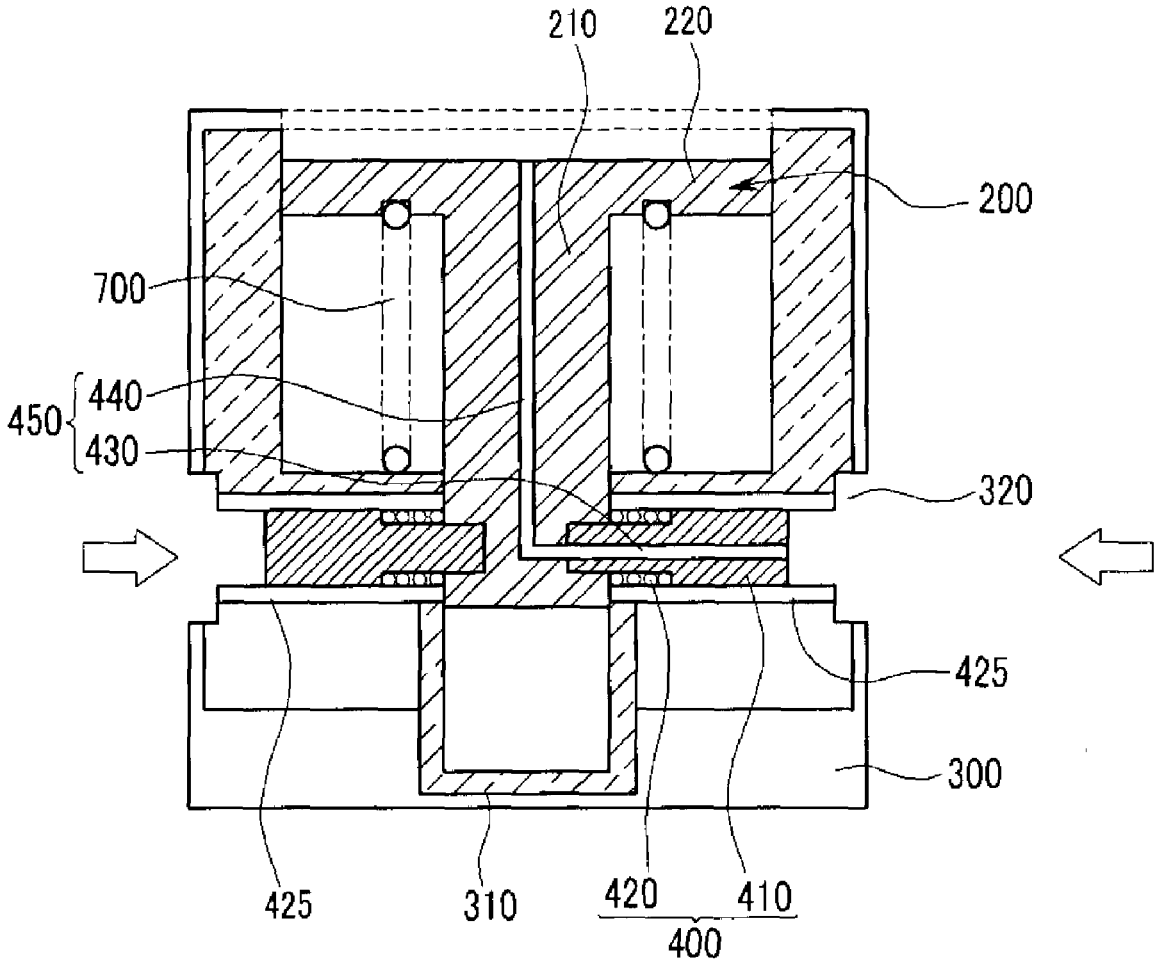
FIG. 4 is a cross-sectional view of a variable valve lift apparatus according to an exemplary embodiment of the present invention in a high lift mode.

FIG. 4 illustrates a high lift mode. In the high loft mode, hydraulic pressure is supplied to the connecting pin 410 through the oil supplying hole 320 and pushes the connecting pin 410 toward the guide 210 of the inner body 200. As the lost motion spring 700 is restored and pushes the inner body 200 upwards, distal end of the connecting pin 410 is coupled to the inner body 200 through an insert hole 445 formed at distal end portion of the guide 210 and thus the inner body 200 and the outer body 300 reciprocate integrally. Accordingly, the inner body 200 and the outer body 300 reciprocate integrally in response to rotation of the first input cam 110, and open/close the valve 500.

In the high lift mode, since the first hydraulic line 430 and the second hydraulic line 440 are connected via the insert hole 445, lubricant may be supplied to a contact surface 220 of the inner body 200 where the inner body 200 contacts the first input cam 110 so that friction of the input cam may be reduced and durability may be enhanced.

To convert the high lift mode to the low lift mode, hydraulic pressure is stopped to be supplied to the connecting pin 410 through the oil supplying hole 320. As a result, the return spring 420 pushes the connecting pin 410 back to the home position and thus the distal end of the connecting pin 410 becomes disengaged from the guide 210 of the inner body 200. Then the lost motion spring 700 draws upper portion of the inner body 200 downwards and thus the guide 210 of the inner body 200 comes back to the lost motion chamber 310, which forms a low lift mode.

A variable valve lift apparatus according to an exemplary embodiment of the present invention may be of a CDA (cylinder deactivation) mode.

That is, a variable valve lift apparatus according to an exemplary embodiment of the present invention realizes a general mode and a CDA mode if the second input cam 120 is removed.

A variable valve lift apparatus according to an exemplary embodiment of the present which may realize a CDA mode is similar to the high lift mode and the low lift mode, and the skilled person in the art may realize this referring to the above-explained description so a detailed explanation will be omitted.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift apparatus comprising:
- an outer body connected with a valve for opening and closing the valve;
- an inner body that is reciprocally disposed within the outer body and contacts a first input cam configured to an input shaft;
- a lost motion spring disposed between the outer body and the inner body;
- a connecting portion selectively connecting the outer body and the inner body;
- a hydraulic pressure supplying portion supplying hydraulic pressure to the connecting portion; and
- a lubrication circuit supplying lubricant to a contacting portion of the first input cam and the inner body;
- wherein the connecting portion comprises:
  - a guide channel formed in a portion of the outer body;
  - at least a connecting pin disposed in the guide channel, the connecting pin inserted into the inner body according to hydraulic pressure receiving from the hydraulic pressure supplying portion; and
  - a return spring disposed in the guide channel, the return spring supplying restoring force to the connecting pin; and
- wherein the hydraulic pressure supplying portion comprises an oil supplying hole formed to the outer body and fluidly communicating with the guide channel of the connecting portion, and
- wherein the lubrication circuit comprises a first hydraulic line formed in one of the at least a connecting pin and a second hydraulic line formed in a guide of the inner body.

2. The variable valve lift apparatus of claim 1, wherein the second hydraulic line fluidly communicates with a contact surface of the inner body and a portion of the guide of the inner body.

3. The variable valve lift apparatus of claim 1, wherein a lost motion chamber is formed in the outer body for a portion of the guide of the inner body to be inserted therein when the connecting pin is separated from the inner body.

4. The variable valve lift apparatus of claim 1, wherein a key hole is formed to an external circumference of the outer body along a direction of reciprocating motion of the outer body, and a key is disposed to the key hole.

5. The variable valve lift apparatus of claim 1, wherein the variable valve apparatus further comprises a second input cam that is disposed to the input shaft and selectively contacts the outer body.

6. The variable valve lift apparatus of claim 5, wherein the first input cam is a high lift cam and the second input cam is a low lift cam.

7. Variable valve lift apparatus comprising:
- an outer body connected with a valve for opening and closing the valve;
- an inner body that is reciprocally disposed within the outer body and contacts a first input cam configured to an input shaft;
- a lost motion spring disposed between the outer body and the inner body;
- a connecting portion selectively connecting the outer body and the inner body;
- a hydraulic pressure supplying portion supplying hydraulic pressure to the connecting portion; and
- a lubrication circuit supplying lubricant to a contacting portion of the first input cam and the inner body;
- wherein the variable valve apparatus further comprises a second input cam that is disposed to the input shaft and selectively contacts the outer body
- wherein the first input cam is a high lift cam and the second input cam is a low lift cam;
- wherein the connecting portion comprises:
  - a guide channel formed in a portion of the outer body;
  - at least a connecting pin disposed in the guide channel, the connecting pin inserted into the inner body according to hydraulic pressure receiving from the hydraulic pressure supplying portion; and
  - a return spring disposed in the guide channel, the return spring supplying restoring force to the connecting pin; and
- wherein the hydraulic pressure supplying portion comprises an oil supplying hole formed to the outer body and fluidly communicating with the guide channel of the connecting portion, and the lubrication circuit comprises a first hydraulic line formed in one of the at least a the connecting pin and a second hydraulic line formed in a guide of the inner body.

8. The variable valve lift apparatus of claim 7, wherein the second hydraulic line fluidly communicates with a contact surface of the inner body and a portion of the guide of the inner body.

9. The variable valve lift apparatus of claim 8, wherein a lost motion chamber is formed in the outer body for the inner body to be inserted therein when the connecting pin is separated from the inner body.

10. The variable valve lift apparatus of claim 9, wherein a key hole is formed to an external circumference of the outer body along a direction of reciprocating motion of the outer body, and a key is disposed to the key hole.

* * * * *